US005495958A

United States Patent [19]

Konrad et al.

[11] Patent Number: 5,495,958

[45] Date of Patent: Mar. 5, 1996

[54] CLOSURE DEVICE FOR A CYLINDRICAL HOUSING

[75] Inventors: Franz Konrad, Regau; Günther Pakanecz; Manfred Lederer, both of Kremsmünster, all of Austria

[73] Assignee: C. A. Greiner & Söhne Gesellschaft m.b.H, Kremsmünster, Austria

[21] Appl. No.: 332,389

[22] Filed: Oct. 28, 1994

Related U.S. Application Data

[62] Division of Ser. No. 131,470, Oct. 4, 1993, which is a division of Ser. No. 963,941, Oct. 20, 1992, Pat. No. 5,275,299, which is a continuation of Ser. No. 573,008, Dec. 6, 1990, abandoned.

[30] Foreign Application Priority Data

| | | | |
|---|---|---|---|
| Apr. 15, 1988 | [AU] | Australia | A 972/88 |
| Dec. 23, 1988 | [AU] | Australia | A 3141/88 |
| Apr. 4, 1989 | [WO] | WIPO | PCT/AT89/00032 |

[51] Int. Cl.[6] ..... B65D 41/04

[52] U.S. Cl. ..... 215/329; 215/320; 215/354; 215/364

[58] Field of Search ..... 215/320, 329, 215/359, 364, DIG. 3, 247, 249, 274, 276, 12.2, 341, 354

[56] References Cited

U.S. PATENT DOCUMENTS

| | | | |
|---|---|---|---|
| 2,748,969 | 6/1956 | Leary | 215/329 |
| 4,230,231 | 10/1980 | Burnett et al. | 215/329 |
| 4,340,148 | 7/1982 | Beckham | 215/329 |
| 4,360,114 | 11/1982 | Owens | 215/329 |
| 4,569,457 | 2/1986 | Hatakeyama et al. | 215/364 |
| 4,637,520 | 1/1987 | Alvi | 215/320 |
| 5,213,224 | 5/1993 | Luch | 215/329 X |

*Primary Examiner*—Gary E. Elkins
*Assistant Examiner*—Christopher T. McDonald
*Attorney, Agent, or Firm*—Collard & Roe

[57] ABSTRACT

In combination with a cylindrical housing, a closure cap including a transverse end wall and cylindrical shell defining a bore and open end. A sealing device arranged between the bore and open end has an outer cylindrical sealing surface mating with an inner cylindrical sealing surface on the housing. A coupling device is arranged between the closure cap and cylindrical housing and includes three spiral webs on the inner surface of the closure cap shell between a first and second transverse plane. The first plane is remote from the end wall and the second plane is close to the end wall, each web having respective ends in the first and second plane, the ends in the first plane being circumferentially spaced from the ends in the second plane by an angle of less than 120 degrees. Three guide lugs radially extend from the cylindrical housing for engagement with the webs, the guide lugs being circumferentially spaced from each other by an angle of about 120 degrees. The second place has a distance from the transverse end wall of the closure cap which exceeds the length of the guide lugs extending parallel to the longitudinal axis of the housing.

11 Claims, 3 Drawing Sheets

Fig.1
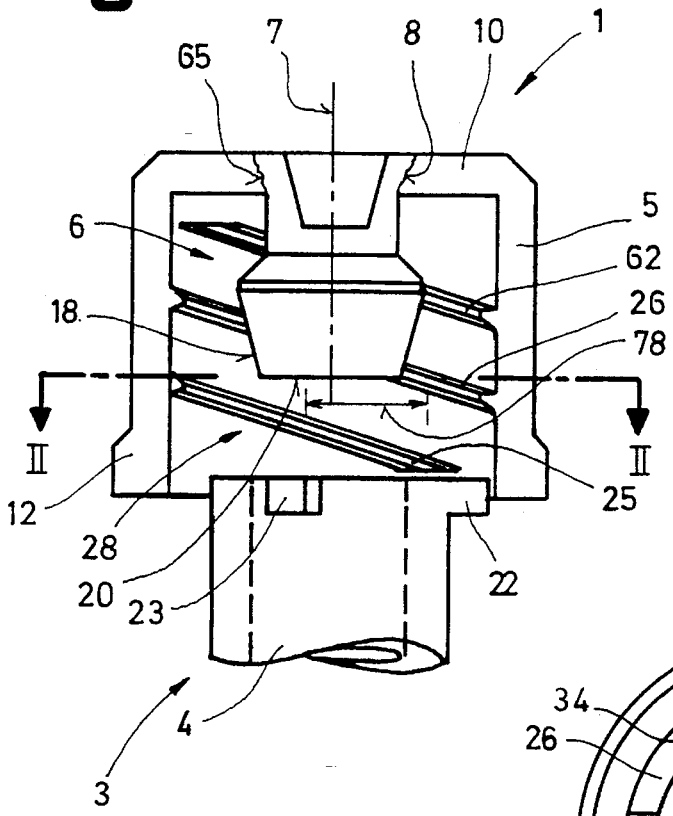
Fig.2
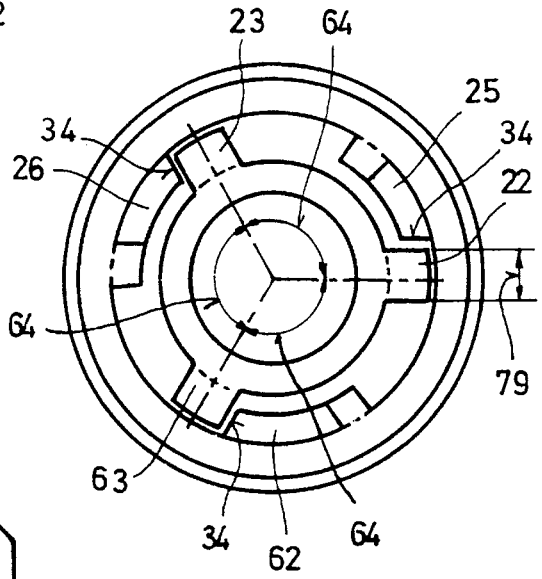
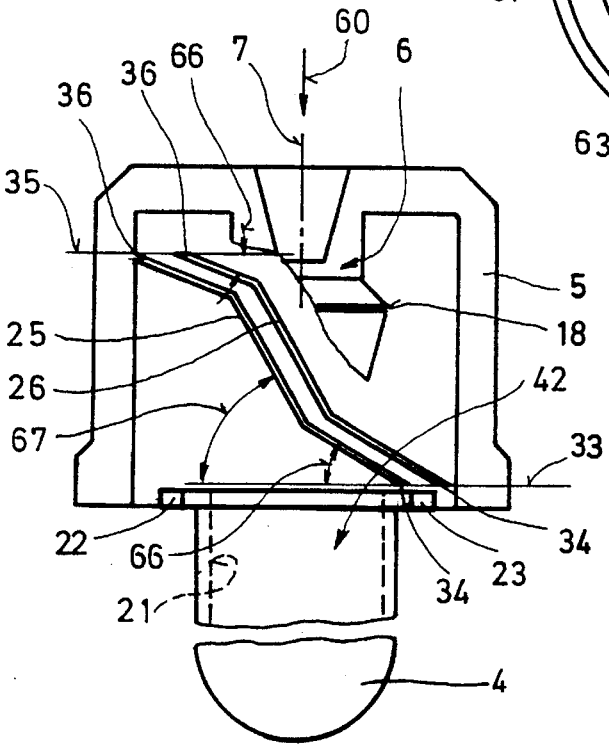
Fig.3

CLOSURE DEVICE FOR A CYLINDRICAL HOUSING

CROSS-REFERENCE TO RELATED APPLICATIONS

This is a division of our U.S. patent application Ser. No. 08/131,470, filed Oct. 4, 1993, which is a division of our U.S. patent application Ser. No. 07/963,941, filed Oct. 20, 1992, now U.S. Pat. No. 5,275,299, which in turn was a continuation of U.S. patent application Ser. No. 07/573,008, filed Dec. 6, 1990, and now abandoned.

BACKGROUND OF THE INVENTION

1. Field of the Invention

The present invention relates to a closure device comprising a closure cap fitting over an open end of a cylindrical housing having a longitudinal axis, the cap having a coincident longitudinal axis and including a transverse end wall extending over the open housing end and defining a bore, and a sealing device arranged between the bore and the open end.

2. Description of the Prior Art

Austrian Patent No. 379,069 discloses; a closure device for a cylindrical housing, in particular a blood-sample tube, which closure device is formed by a cap enclosing an open end of the cylindrical housing. Arranged in the cap is a bore, and provided between the latter and an inner space of the housing is a sealing device. Provided in the bore or in a tubular extension adjoining this bore are projecting portions which protrude beyond the surface of the cap and are covered by the sealing device. Depending on the adhesion force between the sealing device and the cylindrical housing, opening of the closure device without the escape of the medicines or body fluids contained in the housing could not always be ensured.

In addition, a plurality of closure devices for cylindrical housings, in particular for keeping medicines or body fluids, have been disclosed in which one-piece or multi-piece caps have been used with sealing devices. Thus, it is known to close the open end of the cylinderical housing with stopper-like sealing devices which are fixed in turn in these enclosing caps, as, for example, according to U.S. Pat. Nos. 4,465,200, 4,205,754 and 4,089,432, European Patent No. 129,029 and published European patent application No. 257,498. A disadvantage in these closure devices is that very high forces have to be applied in the longitudinal direction of the cylindrical housing in order to overcome the adhesion forces between the sealing device and the cylindrical housings so that medicines or body fluids stored in these housings can escape time after time, and thus chemical burns or infections, in particular during the processing of blood infected with AIDS, can occur. It is also a disadvantage in these closure devices that, when the sealing device is pierced through with a needle to remove the contents, unintentional opening of the closure device can occur.

SUMMARY OF THE INVENTION

It is a primary object of the present invention to create a closure device for a cylindrical housing, in particular a blood-sample tube, with which a reliable gas-tight closure of the inner space of a cylindrical housing of this type can be maintained even for a prolonged storage period and which enables careful opening but also prevents sudden escape of the contents from the cylindrical housing. In addition, a relative movement between the closure device and the cylindrical housing in the longitudinal direction of the same is to be effectively prevented.

In combination with a cylindrical housing having a longitudinal axis and an open end, the above and other objects are accomplished according to one aspect of this invention with a closure cap having a coincident longitudinal axis and fitting over the open housing end, the cap including a transverse end wall extending over the open housing end and defining a bore, and a cylindrical shell depending from the end wall and having a concentric inner surface, a sealing device arranged between the bore and the open end, the sealing device having an outer cylindrical sealing surface mating with an inner cylindrical bearing surface of the cylindrical housing adjacent the open housing end, and a coupling device arranged between the closure cap and the cylindrical housing. The coupling device includes three spiral webs extending on the inner surface of the closure cap shell between a first and second transverse plane extending perpendicularly to the longitudinal axis, the first plane being remote from the end wall and the second plane being close to the end wall, each web having respective ends in the first and second plane, and the web ends in the first plane being circumferentially spaced from the web ends in the second plane by an angle of less than 120°, three guide lugs radially extending from the cylindrical housing at the open end thereof for engagement with the webs, the guide lugs being circumferentially spaced from each other by an angle of about 120°, and the second plane having a distance from the transverse end wall of the closure cap which exceeds the length of the guide lugs extending parallel to the longitudinal axis.

In this combination, the above and other objects are accomplished according to another aspect of the invention with a coupling device which includes two spiral webs extending on the inner surface of the closure cap shell along a longitudinal path at a pitch angle between a first and second transverse plane extending perpendicularly to the longitudinal axis, the pitch angle varying over the longitudinal path, the first plane being remote from the end wall and the second plane being close to the end wall, each web having respective ends in the first and second plane, and the web ends in the first plane being circumferentially spaced from the web ends in the second plane by an angle of less than 180°, two guide lugs radially extending from the cylindrical housing at the open end thereof for engagement with the webs, the guide lugs being circumferentially spaced from each other by an angle of about 180°, and the second plane having a distance from the transverse end wall of the closure cap which exceeds the length of the guide lugs extending parallel to the longitudinal axis.

Such a coupling device ensures in a surprisingly simple manner that the opening movement proceeds not solely in the direction of the longitudinal axis, as a result of which the suction effect as well as the tensile force exerted on the closure device can be reduced. Thus, the sealing device can be prevented from coming out of the cylindrical housing rapidly and, therefore, the risk of the contents, such as medicine or blood, spurting out of the cylindrical housing when it is opened can be reduced. The use of a coupling device with three parallel webs engaged by three guide lugs provides a three-point mounting of the cap on the cylindrical housing so that a virtually centered opening and closing operation can be ensured. A coupling device with two webs extending on the inner surface of the closure cap shell along a longitudinal path at a pitch angle varying over the longitudinal path provides a relatively Short rotational angle for opening and closing the cap while still ensuring that the opening movement, at least at the art and the end, has a considerable component in the peripheral direction, as a result of which a sliding or spiral opening occurs, thus preventing an abrupt pulling out of the sealing device and subsequent risk of medicine or body fluid spurting out of the housing.

The sealing device preferably comprises a gas-tight rubber material at least at the sealing surface thereof. Silicone rubber, bromobutyl rubber or like resilient gas-tight rubber material have the advantage that seals of this type have already been successfully used in connection with medicines and are compatible with body fluids. Also, there is experience available in connection with their gas-tight properties, and they may be pierced by hollow needles.

According to one preferred feature, the sealing device has a highly elastic core surrounded by the cylindrical sealing surface of a rigidity higher than that of the core. The core may have a rigidity of 43° Shore and the rigidity of the sealing surface is higher than 43° Shore. This difference in the hardness of the core and sealing surface imparts a high elasticity to the sealing device core while the sealing surface is relatively hard so that the sealing device is fixed against the effects of forces in an axial and radial direction.

According to another preferred feature, the sealing device is a part of the cap and comprises an element inserted in the bore and having the outer sealing surface extending circumferentially on the element. The element may be a stopper and the outer sealing surface may be an annular portion radially projecting from the element, the annular portion being spaced from the opening housing end an axial distance less than the distance between the first and second planes when the guide lugs are arranged in the area of the first plane. This enables the cap itself to be used for sealing as it is mechanically fixed on the open end of the cylindrical housing.

In accordance with one embodiment of the present invention, the guide lugs are spaced a distance from the open housing end, and the transverse end wall of the cap is spaced from the second plane a distance corresponding to the length of the guide lugs in a direction parallel to the longitudinal axis plus the distance between the guide lugs and the open housing end. This has the advantage that the guide lugs need not be arranged in the plane of the open front end of the cylindrical housing to assure that, in the closed state, the guide lugs may be freely turned in the peripheral direction without the closure device being unintentionally opened.

Adjacent ones of the spiral webs define a groove therebetween, and if the guide lugs have a width in a direction parallel to the longitudinal axis less than the width of the groove in this direction, jamming during opening and closing between the cylindrical housing and the cap will be prevented.

BRIEF DESCRIPTION OF THE DRAWING

The above and other objects, advantages and features of this invention will become more apparent from the following detailed description of certain now preferred embodiments thereof, taken in conjunction with the accompanying drawing wherein FIG. 1 is a sectional side view showing an embodiment of a coupling device according to the invention between a cap and a cylindrical housing;

FIG. 2 shows the coupling device in a sectional plan view along lines II—II of FIG. 1;

FIG. 3 is a sectional side view showing another embodiment of the coupling device according to the invention, having webs running with different pitch;

FIG. 1 shows a closure device 1 for closing an open end of a cylindrical housing 3. This cylindrical housing 3 can be used, for example, as a blood-sample tube 4. To close the open end, the closure device 1 consists of a cap, whose shell 12 encloses this open end, and a sealing device 6. The cap 5 is provided with a bore 8 extending concentrically to a longitudinal axis 7. The sealing device 6 may be a plug formed, for example, of rubber, in particular bromobutyl rubber, silicone rubber or the like, and slips into the open end of tube 4 when being pushed in, and in the process, the indirectly extended portion of the plug engages the inner wall of the tube and locks the sealing device to the tube.

Figure 4:
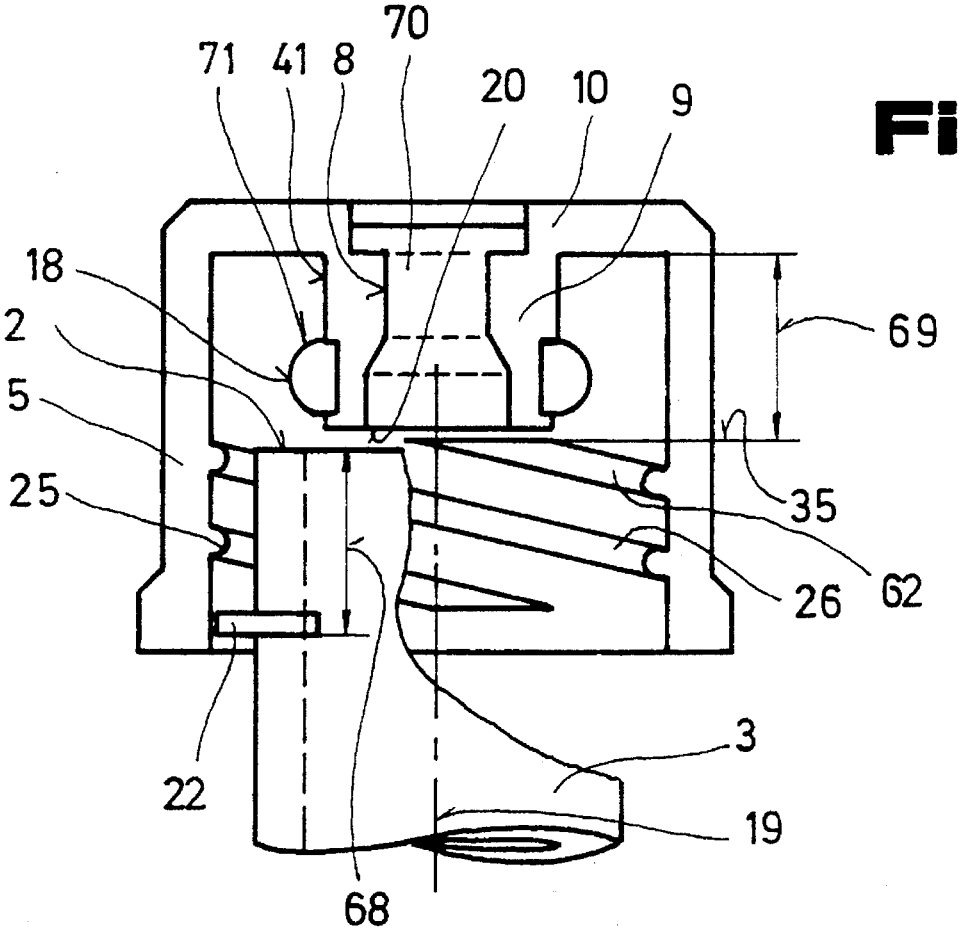
FIG. 4 is a sectional side view showing a further embodiment of a closure device designed according to the invention.

The cylindrical housing 3 can be made of glass or an appropriate plastic, for example polyethylene terephthalate or its copolymers. In order to obtain an adequate gas tightness of this cylindrical housing, it is also possible to apply to its outer surface a gas-barrier layer which can be formed, for example, from a polyvinylidene chloride.

FIGS. 1 and 2 show an embodiment between cap 5 and housing 3 of a closure device 1 in which the coupling device 28 has three webs 25, 26 and 62, the webs, 25, 26 and 62 each extending over an angular range of approximately 270°. Engaging each of the webs 25, 26, 62 is a guide lug 22, 23 and 63 which is connected to the cylindrical housing 3, for example a blood-sample tube 4, or is integrally formed on the latter or is produced by special shaping, for example subsequent hot working. The individual guide lugs 22, 23 and 63 are offset in the peripheral direction by an angle 64 of about 120°. The same also roughly applies to the start 34 of the webs 25, 26 and 62. In this embodiment, the sealing device 6, which forms both the encircling sealing surface 18 and the sealing surface 20 running perpendicularly to the longitudinal axis 7, is connected to the cap shell 12 in a positive-locking manner. This positive-locking connection is achieved during the injection operation for producing the cap shell 12 having the front wall 10 by another plastic having highly elastic properties being injected into the mold to produce the sealing device 6. A fusion action consequently occurs between the two types of material in the area of a seam 65 indicated by a serrated line. It is, of course, also possible for the sealing device 6, after the cap 5 has been produced in a separate injection operation, to be injected or expanded into the bore 8 of the cap 5. Thus, it is also possible for this device 6 to be formed from a plastic foam, for example a polyvinylidene chloride foam or a polyurethane foam or the like. It is simply important for the plastic used to have an adequate gas tightness and elasticity in order to permit a gas-tight closure of the cylindrical housing 3, i.e. the blood-sample tube 4.

FIG. 3 shows an embodiment in which a cap 5 is again provided with a sealing device 6 integrally formed on it. Arranged in the cap 5 are webs 25, 26 whose start 34 is arranged on a transverse plane 33 and whose ends 36 are arranged on a transverse plane 35. Unlike the embodiment described above, however, pitch angles 66, 67 of the webs 25, 26 vary over their path. Thus, the pitch angle 66 runs in a relatively flat manner in the start and end area of webs 25, 26, i.e. approximately transversely to the longitudinal axis 7 of the cap 5, whereas it runs very steeply between these areas, in other words, virtually parallel to the longitudinal axis 7. A relatively short rotational angle is thereby achieved for opening and closing the cap 5, but with it being ensured in this case, too, that, before the sealing device 6 is finally pulled out of the blood-sample tube 4, movement of the cap 5 exclusively parallel to the longitudinal axis 7 is prevented until the encircling sealing surface 18 of the sealing device 6 has been released from the bearing surface 21 in the cylindrical housing. The pitch angle 66 as well as the length of the webs 25, 26 are dimensioned in such a way that this separation of the sealing surface 18 from the bearing surface 21 is complete before the guide lugs 22, 23 have reached the end 36 of the webs 25, 26.

FIG. 4 shows a further embodiment of the invention in which three webs 25, 26 and 62 are arranged in a cap 5. The arrangement of the webs as well as of their peripheral length over which these webs extend can take place as shown, for example, with reference to FIGS. 1 and 2. Engaging the webs 25, 26, 62 arranged in the cap 5 are guide lugs of which only the guide lug 22 on the cylindrical housing 3 can be seen. This guide lug 22 is arranged parallel to a longitudinal axis 19 of the cylindrical housing 3 in such a way as to be spaced by a distance 68 from open end 2 of the cylindrical housing 3. This distance 68 corresponds to a distance 69 between the front wall 10 of the cap 5 and the transverse plane 35 or is slightly smaller. This ensures that, even when the transverse plane 35 is at a greater distance from the front wall 10, the encircling sealing surface 18 can be brought into engagement with the bearing surface 21 in the cylindrical housing 3 by a corresponding arrangement of the guide lugs 22, 23, 63. As further apparent from this figure, two different sealing elements 70, 71 are arranged for producing the sealing surface 20 running perpendicularly to the longitudinal axis and for producing the encircling sealing surface .18. The sealing element 70 is here designed like a stopper which, by appropriate configuration of the bore 8 in the front wall 10, is prevented from falling out in both directions when a force is applied from outside. The sealing element 71 is expanded or sprayed, for example, on a tubular locking extension 9 which defines the bore 8. This expansion or spraying can be effected at the same time as the cap 5 is produced or also separately therefrom. During a separation of the sealing surface 18 from the sealing surface 20 and the use of two different sealing elements, care has to be taken to ensure that the tubular extension 9 is also of a corresponding gas-tight design or is provided with a gas-barrier layer 41 so that ingress or escape of gas through the plastic of this part is adequately prevented.

It is, of course, also possible within the scope of the invention to use the details described with reference to the individual embodiments selectively in the different embodiments and to arrange caps 5 both with the coupling device 13 between the sealing device 6 and the cap 5 and with coupling device 28 between the cap 5 and the cylindrical housing 3 or the blood-sample tube 4 or a housing of a syringe or another vessel.

The two coupling devices 13 and 28 respectively can, of course, also be used completely separately from one another, even in each case only by themselves, on caps 5 or closures of this type for containers for accommodating medicines, foodstuffs, body fluids, cleaning agents or the like. In particular, the use of coupling devices of this type is advantageous wherever a gas-tight closure is to be obtained and there is the risk, on account of the gas-tight closure, of the contents spurting out, in particular during opening, and consequently contagion, infections or chemical burns can occur.

It is also possible within the scope of the invention for the sealing device 6 or the sealing elements 70, 71 to be connected to the cap 5 via a layer of adhesive.

Figure 5:
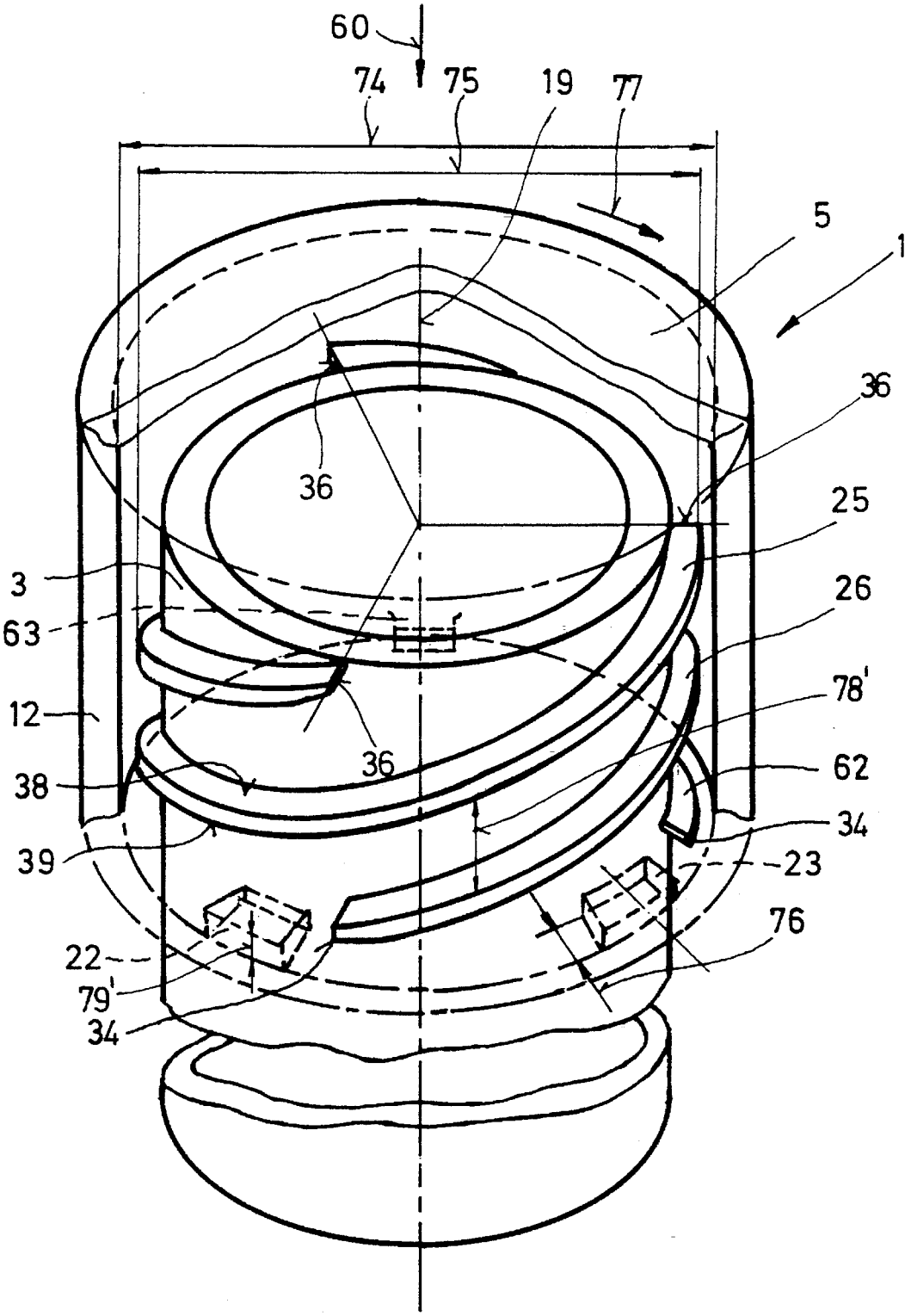
FIG. 5 shows another embodiment of a closure device according to the invention.

FIG. 5 shows an embodiment in which the webs 25 or 26 and 62 are arranged on the cylindrical housing 3. During the manufacturing operation for the cylindrical housing 3, the webs can be directly formed integrally on this cylindrical housing 3 or can be produced by subsequent thermal working.

The guide lugs 22, 23 and 63 engaging webs 25, 26 and 62 protrude inwards beyond the cap shell 12. In this arrangement, an inside diameter 74 of the cap shell 12 is greater than a maximum outside diameter 75 of the cylindrical housing 3 in the area of the webs 25, 26 and 63.

A length 76 of the guide lugs 22, 23 and 63 protruding inwards beyond the cap shell 12 is less than half a difference between the inside diameter 74 and the outside diameter 75. This ensures that the guide lugs 22, 23, 63 and the webs 25, 26, 62 overlap so that the guide lugs 22, 23, 63 can be guided along the webs 25, 26 and 62.

The function of opening and closing the housing 3 with the closure device 1 in the embodiment shown is as follows:

The cap 5, with the guide lugs 22, 23, 63, is moved towards the cylindrical housing 3 by a movement in the direction of arrow 60, that is, in the direction of the longitudinal axis 19 of the cylindrical housing 3, and, with light application of force in the direction of the cylindrical housing 3, is turned in the direction of arrow 77. The guide lugs 22, 23, 63 thereby come to bear on the underside 39 of the webs 25, 26, 62. By a further turn in the direction of arrow 77, the cap 5 is pulled onto the cylindrical housing in the direction of arrow 60. After the ends 36 of the webs 25, 26, 62 have been reached, the cap 5 can be turned further endlessly and with its guide lugs 22, 23, 63 out of engagement with the webs 25, 26, 62.

If the closure device 1 is to be opened, cap 5 has to be turned in the opposite direction of arrow 77 and in the process has to be moved in the opposite direction of arrow 60 relative to the cylindrical housing 3 or lifted from the latter. Consequently, when cap 5 is turned relative to the cylindrical housing 3, guide lugs 22, 23, 63, under a pretension force directed in the opposite direction of arrow 60, run onto the upper side 38 of webs 25, 26, 62, and the cap is pulled out from the cylindrical housing 3 when turned further in the direction of arrow 77. If the selection of the sealing device 6, as already shown in FIG. 3, has now been made in such a way that an overlap area between the sealing area 18 and the bearing area 21 in the cylindrical housing 3 is smaller than a pitch between the transverse planes 33 mounting the starts and ends 34 and 36 respectively, the inner space 42 of the cylindrical housing is cleared as long as free movement of the cap in the opposite direction of arrow 60 is not possible. This prevents the stopper from being pulled suddenly out of the cylindrical housing 3 by an instantaneous, powerful tensile force in the opposite direction of arrow 60 and prevents the contents from spurting out under the resulting vacuum.

Simply for the sake of order, it should be emphasized that a groove width 78' between the webs 25, 26, 62 which runs parallel to the longitudinal axis 7 of the cap 5 or axis 19 of the cylindrical housing 3 is greater than a width 79' of the guide lugs 22, 23, 63. If the width 79' is selected too large, jamming can occur between the guide lugs and webs during opening and closing. This jamming can be reduced when the edges of the lugs are rounded off or these lugs are designed, for example, in the shape of a spherical segment.

Within the scope of the invention, it is also possible for the coupling parts to be formed by a circumferential annular groove in the sealing device 6. In such a design, however, there is only an axial movement between the sealing device 6 and cap 5, i.e. this connection is not secured against rotation.

What is claimed is:

1. In combination with a cylindrical housing having a longitudinal axis and an open end, (a) a closure cap having a coincident longitudinal axis and fitting over the open housing end, the cap including
  (1) a transverse end wall extending over the open housing end and defining a bore, and
  (2) a cylindrical shell depending from the end wall and having a concentric inner surface, (b) a sealing device arranged between the bore and the open end, the sealing device having
  (1) an outer cylindrical sealing surface mating with an inner cylindrical bearing surface of the cylindrical housing adjacent the open end, and (c) a coupling device arranged between the closure cap and the cylindrical housing, the coupling device including
  (1) three spiral webs extending on the inner surface of the closure cap shell between a first and a second transverse plane extending perpendicularly to the longitudinal axis, the first plane being remote from the end wall and the second plane being close to the end wall, each web having respective ends in the first plane and second plane, the web ends in the first plane being circumferentially spaced from he web ends in the second plane by an angle of less than 120°,
  (2) three guide lugs radially extending from the cylindrical housing at the open end thereof for engagement with the webs, the guide lugs being circumferentially spaced from each other by an angle of about 120°, and
  (3) the second plane having a distance from the transverse end wall of the closure cap which exceeds a length of the guide lugs extending parallel to the longitudinal axis.

2. In the combination of claim 1, the sealing device comprises a gas-tight rubber material at least at the sealing surface thereof.

3. In the combination of claim 1, the sealing device has a highly elastic core surrounded by the cylindrical sealing surface of a rigidity higher than that of the core.

4. In the combination of claim 3, the sealing device core has a rigidity of 43° Shore and the rigidity of the sealing surface is higher than 43° Shore.

5. In the combination of claim 1, wherein the sealing device is a part of the cap and comprises an element inserted in the bore and having the outer sealing surface extending circumferentially on the element.

6. In the combination of claim 5, wherein the element is a stopper.

7. In the combination of claim 5, the outer sealing surface being an annular portion radially projecting from the element, the annular portion being spaced from the opening housing end an axial distance less than the distance between the first and second planes when the guide lugs are arranged in the area of the first plane.

8. In the combination of claim 1, the guide lugs being spaced a distance from the open housing end, and the transverse end wall of the cap being spaced from the second plane a distance corresponding to the length of the guide lugs in a direction parallel to the longitudinal axis plus the distance between the guide lugs and the open housing end.

9. In the combination of claim 1, adjacent ones of the spiral webs defining a groove therebetween, the guide lugs having a width in a direction parallel to the longitudinal axis less than the width of the groove in said direction.

10. In the combination of claim 1, the spiral webs extending along a longitudinal path at a pitch angle between a first and second transverse plane extending perpendicularly to the longitudinal axis, the pitch angle varying over the longitudinal path.

11. In combination with a cylindrical housing having a longitudinal axis and an open end, (a) a closure cap having a coincident longitudinal axis and fitting over the open housing end, the cap including
  (1) a transverse end wall extending over the open housing end and defining a bore, and
  (2) a cylindrical shell depending from the end wall and having a concentric inner surface, (b) a sealing device arranged between the bore and the open end, the sealing device having
  (1) an outer cylindrical sealing surface mating with an inner cylindrical bearing surface of the cylindrical housing adjacent the open housing end, and (c) a coupling device arranged between the closure cap and the cylindrical housing, the coupling device including
  (1) x number of spiral webs extending on the inner surface of the closure cap shell along a longitudinal path at a pitch angle between a first and second transverse plane extending perpendicularly to the longitudinal axis, the pitch angle varying over the longitudinal path, the first plane being remote from the end wall and the second plane being close to the end wall, each web having respective ends in the first and second plane, and the web ends in the first plane being circumferentially spaced from the web ends in the second plane by an angle of less than 360° divided by x, wherein x is selected from the numbers 2 and 3,
  (2) x number of guide lugs radially extending from the cylindrical housing at the open end thereof for engagement with the webs, the guide lugs being circumferentially spaced from each other by an angle of about 180°, and
  (3) the second plane having a distance from the transverse end wall of the closure cap which exceeds the length of the guide lugs extending parallel to the longitudinal axis.

* * * * *

UNITED STATES PATENT AND TRADEMARK OFFICE

CERTIFICATE OF CORRECTION

PATENT NO. : 5,495,958

DATED : MARCH 5, 1996

INVENTOR(S) : KONRAD ET AL

It is certified that error appears in the above-identified patent and that said Letters Patent is hereby corrected as shown below:

Cover page, column 1, item [30], Foreign Appliction Priority Data, delete "Australia" (both occurrences) and insert --Austria--.

Signed and Sealed this

Second Day of July, 1996

Bruce Lehman

*Attest:*

BRUCE LEHMAN

*Attesting Officer*

*Commissioner of Patents and Trademarks*